US006311883B1

(12) United States Patent
Greenberg

(10) Patent No.: US 6,311,883 B1
(45) Date of Patent: Nov. 6, 2001

(54) SKI CASE

(76) Inventor: Miriam A. Greenberg, 12 Wyngate Dr., Avon, CT (US) 06001

( * ) Notice: Subject to any disclaimer, the term of this patent is extended or adjusted under 35 U.S.C. 154(b) by 0 days.

(21) Appl. No.: 09/374,946

(22) Filed: Aug. 16, 1999

(51) Int. Cl.[7] ..... A45F 3/02

(52) U.S. Cl. ..... 224/607; 206/315.1; 224/601; 224/917

(58) Field of Search ..... 224/607, 601, 224/917, 917.5, 916, 922; 206/315.4, 315.1, 315.11; 190/104, 105; 383/2

(56) References Cited

U.S. PATENT DOCUMENTS

| | | | |
|---|---|---|---|
| D. 329,743 | 9/1992 | Heisick . | |
| D. 332,695 | 1/1993 | Moscovitch . | |
| 2,180,686 | 11/1939 | Lorinovich . | |
| 2,250,388 | 7/1941 | Mickelberg . | |
| 3,245,448 | 4/1966 | Rea . | |
| 3,737,171 | 6/1973 | Becker . | |
| 3,837,548 | 9/1974 | Nerger . | |
| 3,851,689 | 12/1974 | Kohls . | |
| 3,896,981 | 7/1975 | Purple . | |
| 3,909,031 | 9/1975 | Schmaedeke et al. . | |
| 3,948,302 | 4/1976 | Kohls . | |
| 4,055,287 | 10/1977 | Champenois, Jr. . | |
| 4,161,268 * | 7/1979 | Heil | 224/601 |
| 4,191,233 | 3/1980 | McKay . | |
| 4,196,762 | 4/1980 | Goodwin et al. . | |
| 4,319,617 | 3/1982 | Fusaro . | |
| 4,402,355 | 9/1983 | Wymore et al. . | |
| 4,456,284 | 6/1984 | Saka . | |
| 4,483,380 | 11/1984 | Beran . | |
| 4,553,779 | 11/1985 | Shortridge . | |
| 4,644,986 | 2/1987 | Fusaro . | |
| 4,674,787 | 6/1987 | DeVera . | |
| 4,715,416 * | 12/1987 | Horne | 206/315.1 X |
| 4,746,159 | 5/1988 | Webb . | |
| 4,792,073 | 12/1988 | Jacober . | |
| 4,815,509 | 3/1989 | Owen . | |
| 4,953,773 | 9/1990 | Wirth . | |
| 4,958,760 | 9/1990 | Mulé et al. . | |
| 5,005,743 * | 4/1991 | Ramsay | 224/601 |
| 5,096,104 | 3/1992 | Writh . | |
| 5,104,017 | 4/1992 | Vandagriff . | |
| 5,135,222 | 8/1992 | Spector . | |
| 5,207,323 | 5/1993 | McConnell . | |
| 5,405,002 * | 4/1995 | Troia | 206/315.1 |
| 5,415,333 | 5/1995 | Wills . | |
| 5,417,354 | 5/1995 | Jones . | |
| 5,538,137 | 7/1996 | Deioma et al. . | |
| 5,904,247 * | 5/1999 | Voelkner, Jr. | 206/315.4 |

FOREIGN PATENT DOCUMENTS

| | | | |
|---|---|---|---|
| 120642 | 1/1931 | (AT) . | |
| 2013813 | 10/1971 | (DE) . | |
| 2210833 * | 9/1973 | (DE) | 224/601 |

* cited by examiner

*Primary Examiner*—Gregory M. Vidovich
*Assistant Examiner*—Maerema W. Brevard
(74) *Attorney, Agent, or Firm*—Wiggin & Dana; William B. Slate

(57) ABSTRACT

A case for carrying a pair of skis assembled bottom-to-bottom includes front and rear bags telescopingly overlapping. Preferably, the overlap is effective so that the bindings of downhill skis are accommodated within the overlapping portions of the bags. A padding layer enhances protection while a shoulder strap spans the bags to facilitate carrying by a user.

13 Claims, 3 Drawing Sheets

SKI CASE

BACKGROUND OF THE INVENTION (1) Field of the Invention

The present invention relates to carrying cases for skiing equipment, particularly to carrying cases made up of two separate bags in which a portion of one bag telescopingly overlaps a portion of the other bag.

(2) Description of the Related Art

Numerous types of carrying cases have been used to protect and transport ski equipment. One type commonly employed has been a large, one-piece, duffel-type bag having a longitudinal zipper to permit insertion and removal of skis, poles, and accessories.

Such a case can be very bulky and awkward to carry, especially when not tailored for the user's specific length of skis. By way of example, common adult skis have lengths between about 150 cm and 210 cm. A standard bag is dimensioned to fit the largest ski length and has significant empty space at one or both ends when utilized to carry a shorter ski. Such a bag generally features a thin layer of padding which affords little impact protection to the skis. To accommodate the shorter ski length, one or both ends of the ski bag must be folded over and cinched to stabilize the enclosed skis and prevent movement of the skis during shipping and handling.

BRIEF SUMMARY OF THE INVENTION

Accordingly, one aspect of the present invention is directed to a case for carrying ski equipment comprising: a first bag having a closed end and an open end and capable of enclosing an aft portion of the ski equipment and a second bag having a closed end and an open end and capable of enclosing a fore portion of the equipment, the first and second bags dimensioned to telescopingly overlap when the case is assembled to carry the equipment so that a binding of the equipment is within an overlapping length of said first and second bags.

Another aspect of the present invention is directed to a case for carrying ski equipment comprising: a first bag having a closed end and an open end and capable of enclosing an aft portion of the equipment; a second bag having a closed end and an open end and capable of enclosing a fore portion of the equipment, the first and second bags telescopingly overlapping; and a carry strap having a first portion secured to the first bag and a second portion secured to the second bag and having a length between the first and second portions effective to accommodate the shoulder of a user to serve as a sling for carrying the case and any ski equipment carried therein.

Still another aspect of the present invention is directed to an article which is a combination of a pair of skis and a carrying case and comprises: a pair of skis, each having a fore tip and an aft tail, a shovel extending aft from the tip, a top and a bottom, and a binding having toe and heel portions, wherein the pair of skis are assembled bottom-to-bottom facing in substantially like direction so that their respective bindings face outward; a first bag having a closed end and an open end and enclosing an aft portion of the assembled pair of skis including at least said heel portions of said bindings; a second bag having a closed end and an open end and enclosing a fore portion of the assembled pair of skis including at least said toe portions of said bindings, the first and second bags telescopingly overlapping, wherein both the toe and heel portions of the bindings of both skis are within an overlapping length of said first and second bags.

And one other aspect of the present invention is directed to an article which is a combination of a pair of skis and a carrying case comprising: a pair of skis, each having a fore tip and an aft tail, a shovel extending aft from the tip, a top and a bottom, and a binding having toe and heel portions, wherein the pair of skis are assembled bottom-to-bottom facing in substantially like direction so that their respective bindings face outward; a first bag having a closed end and an open end and enclosing an aft portion of the assembled pair of skis; a second bag having a closed end and an open end and enclosing a fore portion of the assembled pair of skis, the first and second bags telescopingly overlapping; a carry strap having a first portion secured to the first bag and a second portion secured to the second bag and having a free length between the first and second portions effective to accommodate the shoulder of a user to serve as a sling for carrying the article.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 2:
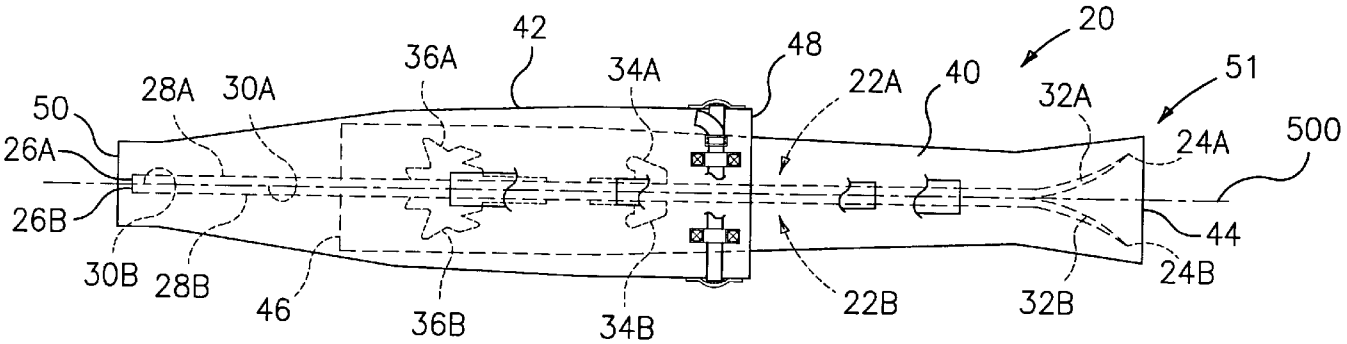
FIG. 2 is a top view of the case of FIG. 1, taken along line 2—2.

The phrase "ski equipment" as employed in the present specification and claims refers to any type of equipment having a bottom surface suitable for skiing or moving across snow, including alpine skis, nordic skis, snowboards and the like.

The phrase "telescopingly overlapping" as used in the present specification and claims refers to where the open portions of the first bag construction of the present invention enters into or fits within the open portion of the second bag construction of the present invention so that the lengthwise combined construction has three portions: a non-overlapping portion of the first bag, an overlapping portion or length of both bags; and a non-overlapping portion of the second bag.

In various preferred embodiments, the second bag may be telescopable within the first bag to accommodate a binding of the equipment within an overlapping length of the first and second bags. When the equipment comprises a pair of alpine skis, both the toe and heel portions of the bindings of both skis may be within an overlapping length of said first and second bags. Each of the first and second bags along substantial portions may include at least an inner fabric layer, an outer fabric layer, and a padding layer of at least one of foam and fibrous fill. Each of the first and second bags may include four panels, being a first pair of panels extending along opposite sides of the assembled pair of skis and a second pair of panels extending between the first pair of panels. Partially exposed cord of at least 0.1 inch diameter may extend along seams between the first pair of panels and the second pair of panels. The carry strap may have a free length between its first and second portions of at least three feet and a relaxed distance (i.e., without tension in the carry strap) between its first and second portions at least six inches smaller than the free length. The carry strap may be positioned substantially along a meeting plane separating the skis.

In various preferred embodiments, the case may further include a first strap having a proximal portion secured to the first bag and a distal portion carrying a connector. A second strap has a proximal portion secured to the second bag and a distal portion carrying a connector, removably mated to the connector of the first strap to secure the first bag to the second bag. A third strap has a proximal portion secured to the first bag and a distal portion carrying a connector. A fourth strap has a proximal portion secured to the second bag and a distal portion carrying a connector, removably mated to the connector of the third strap to secure the first bag to the second bag. The connectors of at least two of the straps are adjustably carried to permit adjustment of the length of the strap between such connectors and the distal ends of the associated straps. The first, second, third, and fourth straps and a carry strap may be positioned substantially along a meeting plane separating the skis. Each of the first and second bags, along substantial portions, may include at least an inner fabric layer, an outer fabric layer, and a padding layer of at least one of foam and fibrous fill. The first bag may include reinforcement strapping extending circumferentially within and stitched through at least the outer fabric layer of the first bag to the proximal portions of the first and third straps. The second bag may include reinforcement strapping extending circumferentially within and stitched through at least the outer fabric layer of the second bag to the proximal portions of the second and fourth straps.

Figure 1:
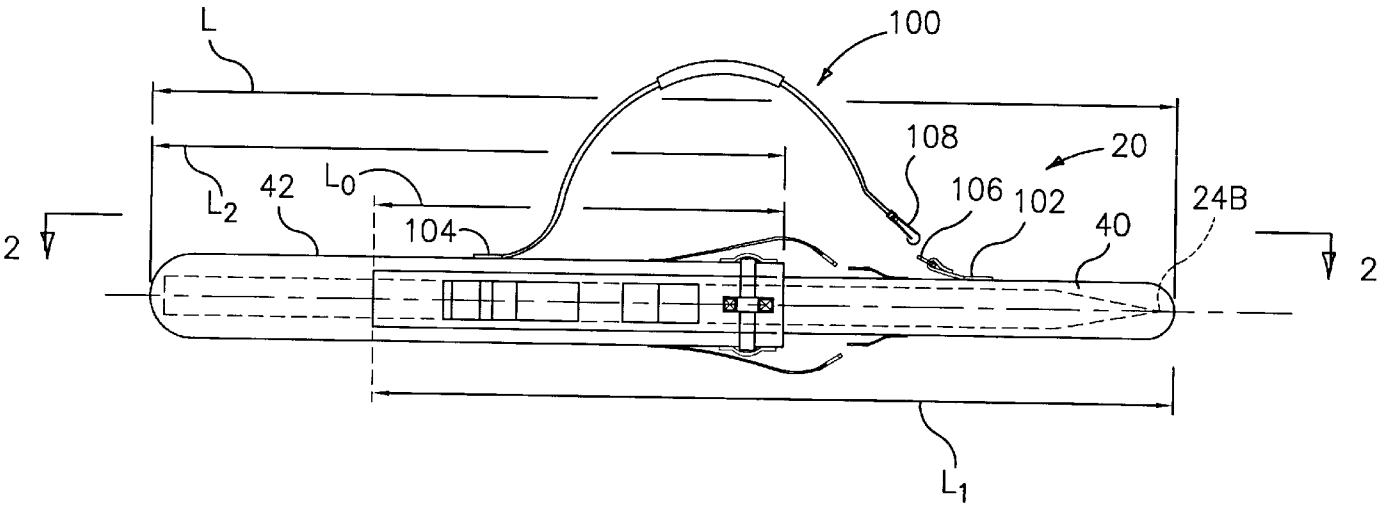
FIG. 1 is a side view of a ski case according to principles of the invention.

FIGS. 1 and 2 show a case for carrying a pair of skis 22A and 22B. Given the difficulties of illustrating the behavior of fabric articles, the drawings are necessarily schematic and do not pictorally show the accommodations made by various fabric items. In the illustrated embodiment, the skis are alpine skis which extend from a fore tip 24A, 24B to an aft tail 26A, 26B. The skis have top and bottom surfaces 28A, 28B and 30A,30B, respectively. A shovel portion 32A, 32B of each ski extends aft from the tip and tapers laterally inward and flares upward toward the tip. On each ski, a binding has a toe piece 34A, 34B and a heel piece 36A, 36B for respectively grasping toe and heel portions of ski boots (not shown). For storage, the skis are assembled bottom-to-bottom, their bottom surfaces meeting substantially along a along a meeting plane 500, so that the respective bindings face outward from that plane and the skis are pointed in substantially the same direction.

The case includes front and rear bags 40 and 42. The front bag extends aft from a closed front end 44 to an open rear end 46. The rear bag extends from an open front end 48 to a closed rear end 50. The front and rear bags have respective lengths $L_1$, and $L_2$ (FIG. 1). An aft portion of the front bag is telescoped within a fore portion of the aft bag along a length $L_0$ so that the overall case length L is substantially $L_1+L_2-L_0$, which may be a few centimeters longer than the skis being protected. Preferably, the bags are dimensioned so that both pieces of each binding lie within the overlapping portions of the bags so as to provide extra protection for the bindings. A pair of ski poles (not shown) can preferably be accommodated within the case, each pole extending along one side of the assembled pair of skis, the baskets of the poles being accommodated within a divergent area 51 at the front end of the front bag between the shovels of the skis.

Figure 4:
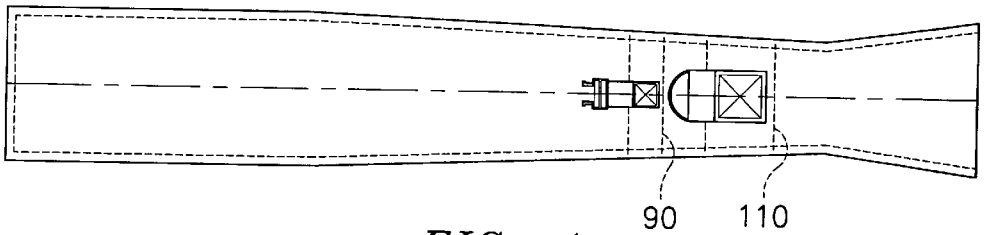
FIG. 4 is a top view of the bag of FIG. 3, taken along line 3—3.
Figure 3:
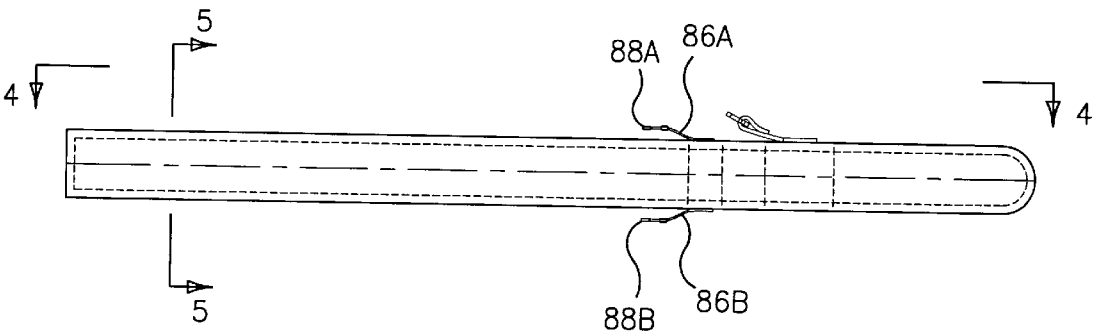
FIG. 3 is a side view of the front bag of the case of FIG. 1.
Figure 5:
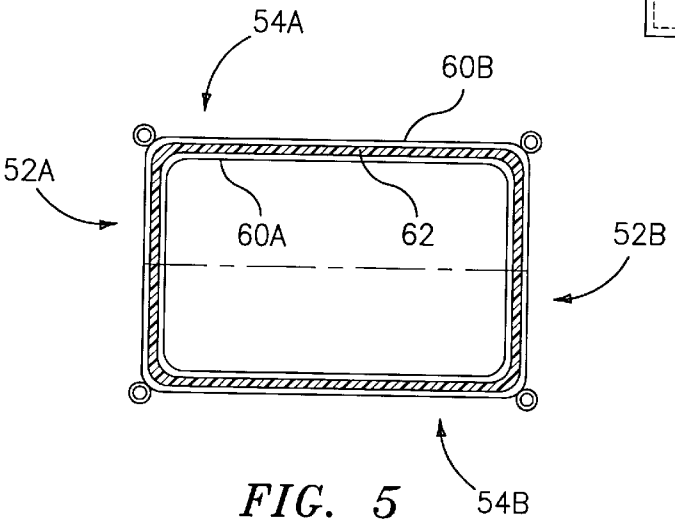
FIG. 5 is a transverse sectional view of the bag of FIG. 3, taken along 5—5.
Figure 8:
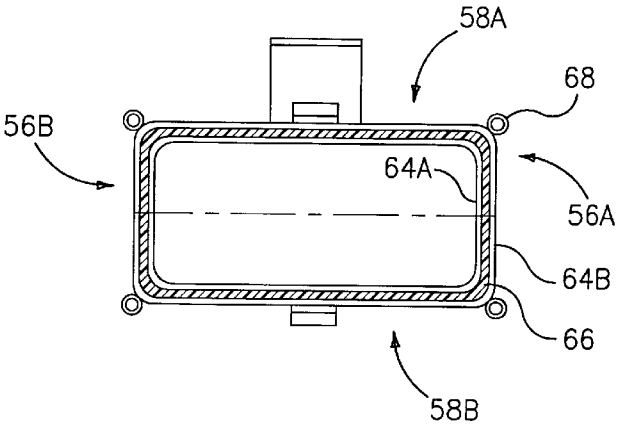
FIG. 8 is a transverse sectional view (stitching not shown) of the bag of FIG. 6, taken along line 8—8.
Figure 7:
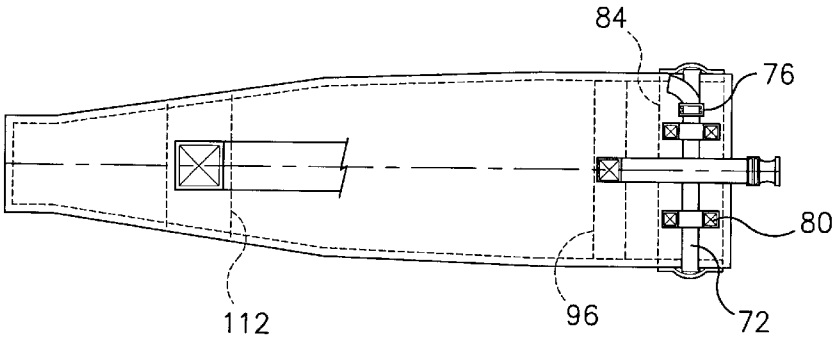
FIG. 7 is a top view of the bag of FIG. 6, taken along line 7—7.
Figure 6:
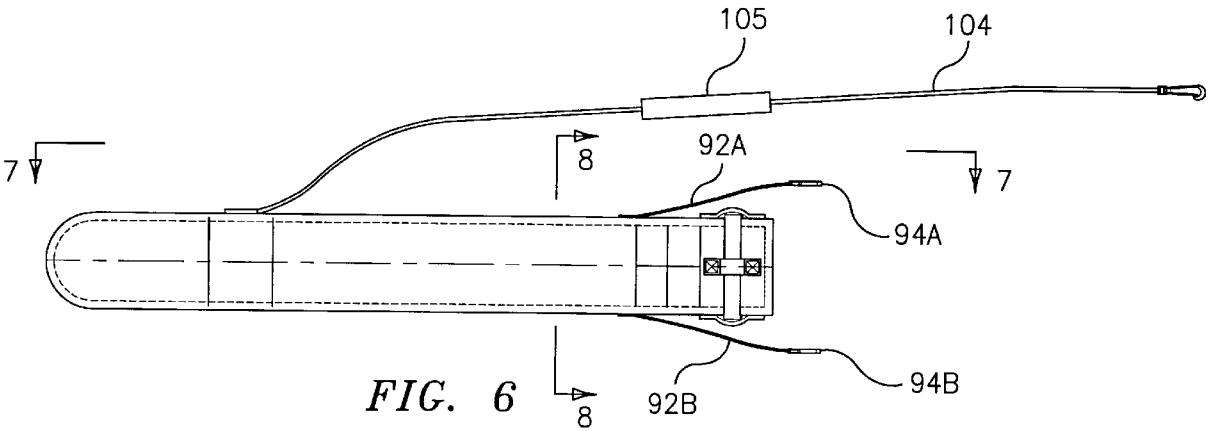
FIG. 6 is a side view of the rear bag of the case of FIG. 1.

FIGS. 3, 4, and 5 are side and top elevational views and a transverse sectional view of the front bag 40. FIGS. 6, 7, and 8 are side and top elevational views and a transverse sectional view of the rear bag 42. In the exemplary embodiment, each bag is of a four panel configuration. The front bag includes a first pair of panels 52A and 52B (FIG. 5) extending along opposites sides of the assembled pair of skis and a second pair of panels 54A and 54B extending between the first pair of panels and respectively spaced apart from the top surfaces 28A and 28B of the skis. Similarly, the rear bag includes a first pair of panels 56A and 56B (FIG. 8) and second pair of panels 58A and 58B. To provide a smooth, unbroken appearance the two first pairs of panels may each be formed as a continuous structure wrapped around at the closed end of the associated bag. On each panel, the front bag has inner and outer fabric layers 60A and 60B (FIG. 5) with a padding layer 62 therebetween. The padding layer is preferably a water-repellant closed-cell foam such as a polyurethane. Other padding materials may be utilized, such as polyester fill or an open-cell film foam (e.g., available from H-O Products Corp., Winsted, Conn). The rear bag 42 may have similar inner, outer and padding layers 64A, 64B, and 66. The fabric layers are preferably formed of a rugged synthetic material (e.g., 450–500 denier CORDURA (trademark of E. I. duPont de Nemours and Company) nylon for the outer layer and 250 denier CORDURA nylon for the inner layer). Fabric having a water repellant treatment is preferred. Additional layering may be present and a variety of seam constructions may be utilized. Preferably, along the scams on the outside of the bags a color contrasting cord 68 (e.g., 250 denier packcloth cord) is sewn in to enhance the bags appearance and protect the seams against abrasion. Interior seams are bound with seam tape for additional strength and wearability.

Advantageously, the outer or overlapping bag (the rear bag in the illustrated embodiment) includes means for cinching its open end. This allows the open end of the rear (outer) bag to be cinched around the front bag and skis ahead of the toe or heel binding pieces (preferably the toe pieces) preventing the rear bag from being pulled off the assembled skis. Similarly, the front (inner) bag may be cinched over the skis preferably aft of the heel piece. Although simple drawstrings may be utilized for cinching, the rear bag of the preferred embodiment includes a cinch strap 72 (FIG. 7) having an adjustment slide 76 and running within a series of belt loops 80. On opposite sides of the cinch strap, the belt loops are stitched through the outer and inner fabric layers to a wide reinforcement strap 84 circumscribing the interior of the bag proximate its open end. Similar cinch means (not shown) may be provided on the front bag.

To longitudinally secure the bags to each other in their assembled configuration, the bags include mateable connecting straps. In the illustrated embodiment, the front bag (FIG. 3) includes straps 86A, 86B each having a proximal portion secured to respective top and bottom panels 54A and 54B of the front bag and a distal portion carrying a respective connector moiety 88A and 88B. A reinforcement strap 90 (FIG. 4) circumscribes the interior of the front bag and is stitched through to the proximal ends of the straps 86A and 86B to secure such straps to the bag. The rear bag 42 (FIGS. 6 and 7) similarly has mating straps 92A and 92B, connector moieties 94A and 94B, and a reinforcement strap 96. The connector moieties 88A and 88B are respectively mateable with the connector moieties 94A and 94B. By way of example, these may respectively be male and female contoured one-inch side-release buckles. Preferably the connector moieties 94A and 94B are slidably mounted to provide adjustment of the length of strapping material between such connector moieties and the proximal ends of their associated straps. This advantageously allows for easy length adjustment of the assembled case for various length skis.

A carry strap system 100 (FIG. 1) extends between the front and rear bags. The strap has a front portion 102 secured to the front bag and a rear portion 104 secured to the rear bag. The rear portion 104 may carry a shoulder pad 105 (FIG. 6) for user comfort. When the case is assembled and in a preferred condition for shoulder-slung carrying by a user, the distance between the front and rear portions and, furthermore, the greater length of strapping between such portions, are effective to provide enough slack to allow the space between the carry strap and bags to accommodate the shoulder of the user. By way of example, the distance may be about 2.5–4 feet while the length may be about 6–9 inches longer to provide the desired slack. The strap 100 may be formed in front rear pieces joined by connector moieties (e.g., a ring 106 and a clasp 108) to permit the bags to be completely disengaged from each other for insertion and removal of the skis. Reinforcement straps 110 and 112 (FIGS. 4 and 6, respectively) may circumscribe the interior of the associated bag and be stitched through to the associated ends of the strap system 100. Optionally, the carry strap system may include one or more length adjustment slides which could be used to set the desired slack in the strap for carrying and then to tighten strap for transport. The strap system may include additional connectors which allow complete removal of the bulk of the strap for airline transportation and the like.

In an exemplary manufacturing process, for each of the bags, the inner and outer fabric layers are cut to the appropriate size for the various panels. The padding layer for each panel is cut slightly smaller to provide a seam allowance on the fabric layers. The various strapping material (e.g., connecting, reinforcement, and carry) may be pre-cut and may have their associated connectors and the like pre-installed. The bags are assembled inside-out and then righted. Specifically, the portions of the outer fabric layer are brought together and the reinforcement strapping stitched to the exposed surface (which will, when righted, become the inner surface of the outer layer). The padding and inner layer pieces are then placed atop the outer layer and the remaining appropriate straps are put in place (on the surface that will become the outer surface of the outer layer) and stitched through: the outer layer; the associated reinforcement strapping; the padding layer; and the inner layer. The cord is then placed along the junctions between the panels and the fabric pieces and cord are sewn together defining seams between the panels. The seams are then taped. Along the open ends of the bag the fabric layers are stitched together to encapsulate the padding.

In use, the skis are assembled bottom-to-bottom and their tips inserted into the open end of the front bag until they reach the front end thereof. Ski poles may be inserted along with the skis or thereafter. The open end of the rear bag is then placed over the exposed heels of the skis and drawn forward so that the open end of the front bag telescopes within the rear bag until the ski heels have reached the rear end of the rear bag. At this point the connecting straps are secured and cinched tight if necessary to prevent the bags from pulling apart. Additionally, the cinch strap 72 may be tightened to constrict the open end of the rear bag around the front bag and the skis to prevent dirt and the like from entering the bags. The carry strap connectors are secured to each other and the carry strap may be adjusted to allow the user to comfortably place his or her arm between the carry strap and the assembled bags to carry the assembled bags and skis in a tip-up orientation across his or her back.

One or more embodiments of the present invention have been described. Nevertheless, it will be understood that various modifications may be made without departing from the spirit and scope of the invention. For example, a variety of embellishments and enhancements (e.g., addition of pockets) may be included. Various substitutions of materials and components may be made and the case may be tailored to accommodate the specific needs of any group of users. Accordingly, other embodiments are within the scope of the following claims.

What is claimed is:

1. A case for carrying ski equipment, comprising:

a first bag having a closed end and an open end and capable of enclosing an aft portion of the ski equipment;

a second bag having a closed end and an open end and capable of enclosing a fore portion of the ski equipment, the first and second bags dimensioned to telescopingly overlap when the case is assembled to carry the ski equipment so that a binding of the ski equipment is within an overlapping length of said first and second bags;

a first connecting strap having a proximal portion secured to the first bag and a distal portion carrying a connector;

a second connecting strap having a proximal portion secured to the second bag and a distal portion carrying a connector, removably mated to the connector of the first connecting strap to secure the first bag to the second bag;

a third connecting strap having a proximal portion secured to the first bag and a distal portion carrying a connector;

a fourth connecting strap having a proximal portion secured to the second bag and a distal portion carrying a connector, removably mated to the connector of the third connecting strap to secure the first bag to the second bag, the connectors of at least two of the connecting straps being adjustably carried to permit adjustment of the lengths of such connecting straps between such connectors and the distal ends of the associated connecting straps; and a carry strap having a first portion secured to the first bag and a second portion secured to the second bag and having a length between the first and second portions effective to accommodate the shoulder of a user to serve as a sling to carry the case, with said respectively mated first and second and third and fourth connecting straps tight to prevent the first and second bags from pulling apart.

2. The case of claim 1 wherein substantial portions of each of the first and second bags include at least an inner fabric layer, an outer fabric layer, and a padding layer selected from the group consisting of foam, fibrous fill and mixtures thereof.

3. The case of claim 2 wherein the first bag includes reinforcement strapping extending circumferentially within and stitched through at least the outer fabric layer of the first bag to the proximal portions of the first and third connecting straps, and the second bag includes reinforcement strapping extending circumferentially within and stitched through at least the outer fabric layer of the second bag to the proximal portions of the second and fourth connecting straps.

4. The case of claim 1 wherein each of the first and second bags comprises:

four panels, being:

a first pair of panels extending along opposite sides of the assembled pair of skis;

and a second pair of panels extending between the first pair of panels; and partially exposed cord of at least 0.1 inch diameter extending along seams between the first pair of panels and the second pair of panels.

5. The case of claim 1 wherein at least one bag of said first and second bags comprises means for cinching the open end of said at least one bag.

6. The case of claim 1 wherein at least one bag of said first and second bags comprises a cinch strap for cinching the open end of said at least one bag.

7. An article comprising:

a pair of skis, each having:

a fore tip and an aft tail;

a shovel extending aft from the tip;

a top and a bottom; and a binding having toe and heel portions, wherein the pair of skis are assembled bottom-to-bottom facing in substantially like direction so that their respective bindings face outward;

a first bag having a closed end and an open end and enclosing an aft portion of the assembled pair of skis;

a second bag having a closed end and an open end and enclosing a fore portion of the assembled pair of skis, the first and second bags telescopingly overlapping; and a carry strap having a first portion secured to the first bag and a second portion secured to the second bag and having a free length between the first and second portions effective to accommodate the shoulder of a user to serve as a sling for carrying the article; a first strap having a proximal portion secured to the first bag and a distal portion carrying a connector; a second strap having a proximal portion secured to the second bag and a distal portion carrying a connector, removably mated to the connector of the first strap to secure the first bag to the second bag; a third strap having a proximal portion secured to the first bag and a distal portion carrying a connector; and a fourth strap having a proximal portion secured to the second bag and a distal portion carrying a connector, removably mated to the connector of the third strap to secure the first bag to the second bag, the connectors of at least two of the straps being adjustably carried to permit adjustment of the length of those connecting straps between such connectors and the distal ends of the associated connecting straps.

8. The article of claim 7 wherein with the first and second straps so mated and third and fourth straps so mated and cinched tight, the carry strap has said free length to so serve as a sling.

9. The article of claim 7 wherein the first, second, third, and fourth connecting straps and the carry strap are positioned substantially along a meeting plane separating the skis.

10. The article of claim 9 wherein each of the first and second bags along substantial portions includes at least an inner fabric layer, an outer fabric layer, and a padding layer selected from the group consisting of foam, fibrous fill and mixtures thereof.

11. The article of claim 10 wherein the first bag includes reinforcement strapping extending circumferentially around the pair of skis and stitched through at least the outer fabric layer of the first bag to the proximal portions of the first and third straps, and the second bag includes reinforcement strapping extending circumferentially around the pair of skis and stitched through at least the outer fabric layer of the second bag to the proximal portions of the second and fourth straps.

12. The article of claim 7 wherein the second bag is telescoped within the first bag and wherein both the toe and heel pieces of both skis are within an overlapping length of said first and second bags.

13. The article of claim 7 wherein the carry strap has the free length between its first and second portions of at least three feet.

* * * * *